United States Patent [19]

Kasamatsu et al.

[11] 4,210,445

[45] Jul. 1, 1980

[54] NIOBIUM-CONTAINING WELDABLE STRUCTURAL STEEL HAVING GOOD WELDABILITY

[75] Inventors: Yutaka Kasamatsu, Mikagenakamachi; Mutsuo Hiromatsu, Akashi; Syuzi Takashima, Kakogawa; Takasi Hosoya, Akashi; Takamichi Hamanaka, Kakogawa, all of Japan

[73] Assignee: Kobe Steel, Limited, Kobe, Japan

[21] Appl. No.: 884,384

[22] Filed: Mar. 8, 1978

[30] Foreign Application Priority Data

Oct. 18, 1977 [JP] Japan ..... 52-125249

[51] Int. Cl.[2] ..... C22C 38/04; C22C 38/12; C21D 7/14

[52] U.S. Cl. ..... 75/124; 75/123 J; 75/123 M; 75/123 N; 75/125; 75/126 D; 75/126 F; 75/128 G

[58] Field of Search ..... 75/124, 123 M, 123 J, 75/123 N, 125, 126 D, 126 F, 128 G, 128 T; 148/36

[56] References Cited

U.S. PATENT DOCUMENTS

| | | | |
|---|---|---|---|
| 3,132,025 | 5/1964 | Hurley | 75/123 R |
| 3,592,633 | 7/1971 | Osuka et al. | 75/124 |
| 3,619,303 | 11/1971 | Semel | 75/123 J |
| 3,721,587 | 3/1973 | Alten et al. | 75/124 |
| 3,725,049 | 4/1973 | Satoh et al. | 75/123 J |
| 3,761,324 | 9/1973 | Elias et al. | 148/36 |
| 3,767,387 | 10/1973 | Yamaguchi et al. | 75/124 |
| 3,773,500 | 11/1973 | Kanazawa et al. | 75/124 |
| 3,807,990 | 4/1974 | Gohda et al. | 75/124 |
| 3,853,639 | 10/1974 | Hughes | 148/36 |
| 4,033,789 | 7/1977 | Hamburg et al. | 148/134 |
| 4,043,807 | 8/1977 | Kirman | 75/124 |
| 4,058,414 | 11/1977 | Matsuoka | 75/123 N |
| 4,120,440 | 10/1978 | Kirkwood | 75/123 M |

FOREIGN PATENT DOCUMENTS

| | | | |
|---|---|---|---|
| 49-22285 | 6/1974 | Japan | 75/123 J |
| 52-128821 | 10/1977 | Japan . | |
| 52-131923 | 11/1977 | Japan . | |

*Primary Examiner*—L. Dewayne Rutledge
*Assistant Examiner*—Upendra Roy
*Attorney, Agent, or Firm*—Oblon, Fisher, Spivak, McClelland & Maier

[57] ABSTRACT

Disclosed herein is a niobium-containing weldable structural steel having good weldability which consists of 0.005–0.04% of C, 0.01–0.50% of Si, 1.20–2.50% of Mn, 0.01–0.07% of Nb, 0.005–0.030% of Ti, 0.005–0.06% of Al and the balance of iron and inevitable impurities whereby [C(%)+10N(%)] is not greater than 0.10% and Ti(%)/[C(%)+10N(%)] is from 0.05 to 0.60 in order to restrict the amount of martensite islands in the weld heat affected zone to not greater than 15% in terms of the area fraction.

2 Claims, 6 Drawing Figures

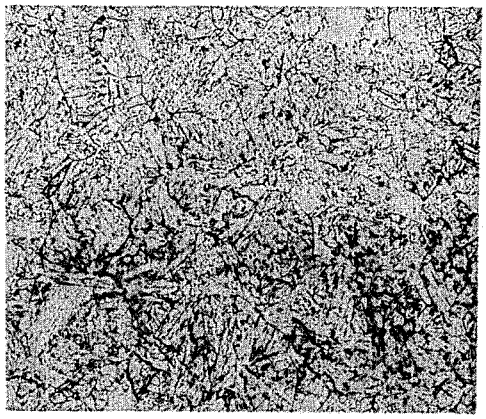
FIG. 4 (I)
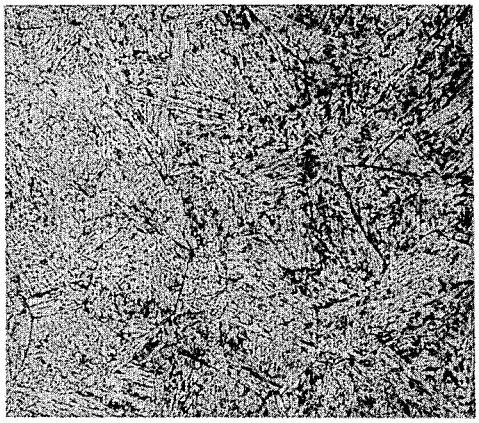
FIG. 4 (II)

NIOBIUM-CONTAINING WELDABLE STRUCTURAL STEEL HAVING GOOD WELDABILITY

BACKGROUND OF THE INVENTION

1. Field of the Art

This invention relates to niobium-containing weldable structural steel having good weldability. More specifically, the present invention relates to a niobium-containing weldable structural steel having yield strength of 40–70 kg/mm$^2$ prepared by providing a niobium-containing steel with a predetermined composition so as to improve toughness in the weld heat affected zone and resistance to weld cracking.

2. Description of the Prior Art

When added in a small amount to steel, niobium improves the strength and toughness of steel, and is an economically advantageous element. It is for this reason that a niobium-containing steel (hereinafter referred to as "Nb-containing steel") has gained a wide application as a weldable structural steel for pipe lines, ship-building, pressure containers, bridges and the like. Among numerous applications of the Nb-containing steel, the detailed description is hereby presented about line pipe steels used in specifically great quantities. Nb-containing non-quenched tempered high tensile strength steel has conventionally been used in great quantities for pipe lines for transporting crude oil and natural gas. However, the pipe lines that have so far been laid down have a small pipe diameter and low inner pressure and are used at a relatively high temperature of not lower than about 0° C. Hence, requirement for toughness in the weld heat affected zone has not been much serious.

As laying of pipe lines has gradually been concentrated on the ultra-cold region such as in U.S.S.R., Canada, U.S.A., etc. and the material transported has also been changed gradually from crude oil to natural gas, however, an unexpected problem has come to the front. The conventional Nb-containing steel for pipe line causes embrittlement of the weld heat affected zone (HAZ) in the seam weld portion at the time of steel making and hence, fails to ensure sufficient toughness to withstand the use in such regions. As countermeasures, a multiple-electrode submerged arc welding process of a low restricted weld heat input or a MIG welding process has been examined on one hand in the aspect of the welding process, in order to mitigate the influence of the welding heat. Research and development has been made on the other hand in the aspect of the steel material to be used, in order to obtain a steel having such a composition of economical components that does not cause degradation of the weld heat affected zone. With regard to the properties of the steel material especially, the most desirable steel would be one that does not cause embrittlement of the weld heat affected zone and yet exhibits good notch toughness even when welding of a large weld heat input such as one side welding or both side welding with one or two layers (not more than three passes in each weld groove) is carried out in order to improve the welding efficiency and reduce the cost of production of the pipe. At the same time, the steel must satisfy a specific requirement of low weld crack sensitivity for the purpose of preventing cracks of the weld portion because when the on-the-site welding is effected in the cold zone, a high cellulose type electrode of a high hydrogen content is generally employed without preheating of the pipe in the low temperature atmosphere.

It has been a pressing need for those concerned in the art to develop a steel strip for a line pipe which simultaneously satisfies the abovementioned requirements, i.e., to have excellent toughness in the weld heat affected zone and to be less hardenable and excellent in its resistance to weld cracking.

Incidentally, the following U.S. patents are located as the prior art most relevant to the present invention;

U.S. Pat. Nos. 3,592,633, 3,807,990, 3,619,303, 3,725,049, 3,721,587 and 3,132,025.

SUMMARY OF THE INVENTION

The present invention contemplates to solve in a rational manner the aforementioned various problems involved with welding of the Nb-containing steel and is directed to provide a Nb-containing weldable structural steel, especially a Nb-containing steel for pipe line, having good toughness in the weld heat affected zone and improved resistance to weld cracking.

To accomplish the abovementioned object, the first embodiment of the present invention provides a Nb-containing weldable structural steel having good weldability which consists of 0.005–0.04% of C, 0.01–0.50% of Si, 1.20–2.50% of Mn, 0.01–0.07% of Nb, 0.005–0.030% of Ti, 0.005–0.06% of Al and the balance of iron and inevitable impurities whereby [C(%)+10 N(%)] is not greater than 0.10% and Ti(%)/[C(%)+10 N(%)] is from 0.05 to 0.60 in order to restrict the amount of the martensite island in the weld heat affected zone to not greater than 15% in terms of the area fraction.

The second embodiment of the present invention provides a Nb-containing weldable structural steel having good weldability which consists of 0.05–0.04% of C, 0.01–0.50% of Si, 1.20–2.50% of Mn, 0.01–0.07% of Nb, 0.005–0.030% of Ti, 0.005–0.06% of Al, at least one element in the specified amount selected from the group consisting of up to 0.50% of Cu, up to 1.50% of Ni, up to 0.50% of Cr, up to 0.60% of Mo, up to 0.10% of V, up to 0.003% of B, up to 0.02% of Ce and up to 0.003% of Ca, and the balance of iron and inevitable impurities whereby [C(%)+10 N(%)] is not greater than 0.10% and Ti(%)/[C(%)+10 N(%)] is from 0.05 to 0.60% in order to restrict the amount of the martensite island in the weld heat affected zone to not greater than 15% in terms of the area ratio.

In the first embodiment of the present invention, the third embodiment thereof provides a Nb-containing steel for line pipe as said Nb-containing weldable structural steel.

In the second embodiment of the present invention, the fourth embodiment thereof provides a Nb-containing steel for line pipe as said Nb-containing weldable structural steel.

BRIEF DESCRIPTION OF THE DRAWINGS

FIGS. 4-[I] and -[II] each are photographs showing the microstructure near the weld bond portion (magnification: 200×)

DETAILED DESCRIPTION OF THE PREFERRED EMBODIMENTS

Figure 1:
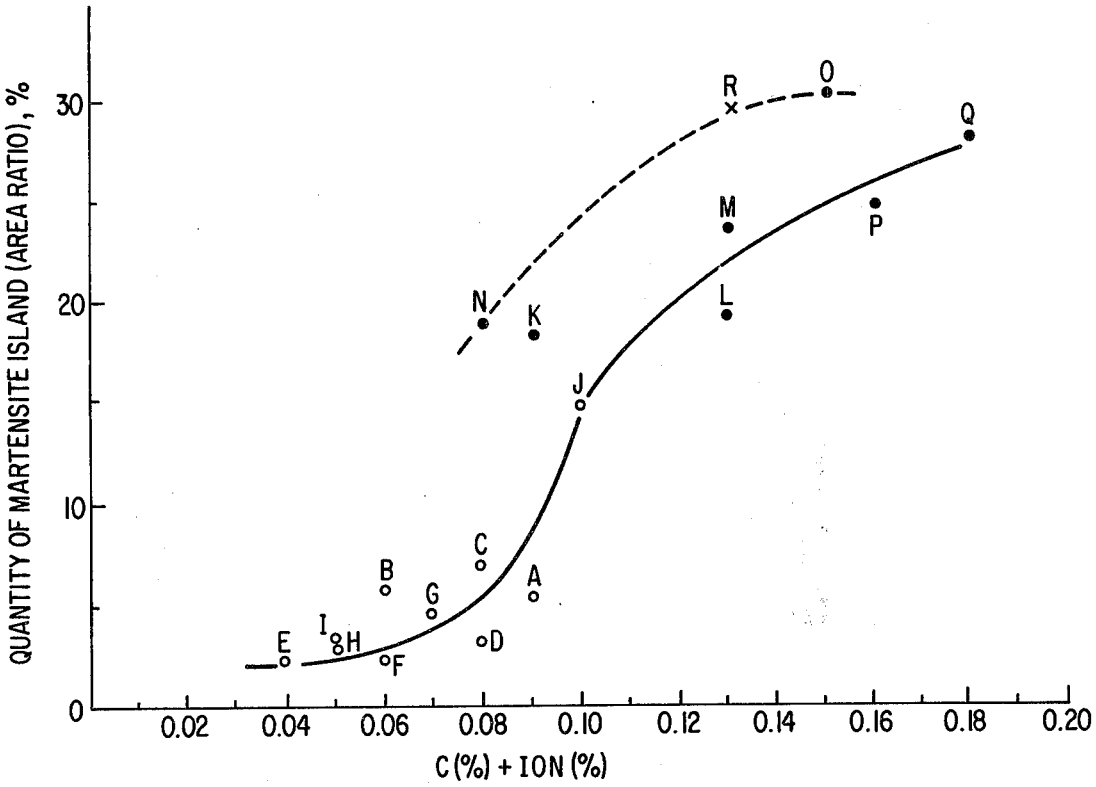
FIG. 1 is a diagram showing the relationship between the amount of the martensite island in the weld heat affected zone and [C(%)+10 N(%)]

It is well known that when welding of a high weld heat input such as automatic welding is applied to a weldable structural steel in general, the weld heat affected zone, especially the weld bond of joint and the portions near the bond, are embrittled. To prevent this embrittlement, it is believed effective to convert the structure of the heat affected zone to fine ferrite.pearlite, lower bainite or a mixed structure of the lower bainite and martensite. However, this method cannot be used as effective means for a Nb-containing steel dealt with by the present invention, since the structure formed in the weld heat affected zone varies in accordance with the hardenability of the steel. When the ferrite.pearlite structure is desired, for instance, hardenability must not be so high, thereby restricting inevitably the amounts of alloy elements to be added. Hence, this method is applicable only to a steel consisting principally of a Si-Mn system of a yield strength of 20–40 kg/mm$^2$ class having a small alloy addition amount. If the method is applied to a Nb-containing steel, there is obtained an upper bainite structure having extremely inferior toughness and on the contrary, promoting the embrittlement of the heat affected zone.

In order to obtain the lower bainite structure or the mixed structure of the lower bainite and martensite, on the other hand, it is necessary to use a steel incorporating expensive elements such as Ni, Cr, Mo, etc. in great quantities. However, the steel containing great amounts of these elements has extremely inferior resistance to weld cracking and invites a drastic increase in the cost of production. For these reasons, it is difficult to use a steel of this type as a weldable structural steel.

In the Nb-containing steel, too, the weld bond of joint and the portion near the bond are rapidly heated to about 1,300° C. or more at the time of welding. Consequently, Nb-carbonitrides that have precipitated during rolling of the product or after quenching and tempering are thermally decomposed by the welding heat, resolve in the matrix and thus substantially cause a remarkable increase in the hardenability, hardening of the bond and its proximity, and deterioration of resistance to weld cracking. Hardening of the heat affected zone can therefore be prevented theoretically by minimizing the resolution amount of Nb. However, this is contradictory to, and spoils, the essential feature of the Nb-containing steel.

The present inventors have made intensive studies in an attempt to find the causes of deterioration of toughness in the heat affected zone and to establish means for preventing the same. They have also studied a method of improving the resistance to weld cracking of a Nb-containing steel while making the most of the feature of the Nb-containing steel that it provides high strength at a cheap cost, in order to adapt the steel to a weldable structural steel, especially to a steel for line pipe.

As a result, the inventors have now clarified that mass-like or spherical structures, or so-called "martensite islands", occurring in the upper bainite structure formed in the weld heat affected zone at the time of welding of a large weld heat input such as one side welding with one welding pass or both side welding with one welding pass in each groove, are the point of occurrence or transmission route of brittle cracking. When the quantity of the martensite islands exceeds 15%, the toughness of the steel is extremely deteriorated. Accordingly, the inventors have furthered their studies in order to obtain a steel composition which mitigates the adverse influence arising from the formation of the martensite islands and improves the resistance to weld cracking, and thus found that the amount of the martensite islands can be restricted to not greater than 15% and weldability can also be remarkably improved by stipulating the proportion of C, Si, Mn, Nb, Ti, etc. to a specific ratio as well as by stipulating the amounts of C, Ti and N to a specific interrelationship. The present invention is completed on the basis of these findings.

Namely, in accordance with the present invention, there is provided a Nb-containing weldable structural steel consisting of 0.005–0.04% of C, 0.01–0.50% of Si, 1.20–2.50% of Mn, 0.01–0.07% of Nb, 0.005–0.030% of Ti, 0.005–0.06% of Al, at least one element in the prescribed amount, if necessary, selected from the group consisting of up to 0.50% of Cu, up to 1.0% of Ni, up to 0.50% of Cr, up to 0.60% of Mo, up to 0.10% of V, up to 0.003% of B, up to 0.02% of Ce and up to 0.003% of Ca, and the balance of iron and inevitable impurities whereby [C(%)+10 N(%)] is not greater than 0.10% and Ti(%)/[C(%)+10 N(%)] is from 0.05 to 0.60, in order to restrict the amount of the martensite island in the weld heat affected zone to not greater than 15% and effectively prevent or mitigate the adverse influence over the toughness and weld crack sensitivity.

It is thus possible in accordance with the present invention to altogether solve the aforementioned problems involved with welding of the Nb-containing steel, to provide the weld heat affected zone with high toughness and high resistance to weld cracking during welding of a large weld heat input such as automatic or semiautomatic welding including one side welding with one welding pass, both side welding with two layers and circular seam welding, and to guarantee a yield strength of a class of as high as 40 to 70 kg/mm$^2$.

Explanation will now be given in detail why the components of the Nb-containing steel of the present invention are stipulated to a specific ratio.

In cooperation with Ti and N to be later described, a reduced C content restricts the formation of the martensite island, enhances the toughness in the weld heat affected zone and allows the Nb-containing steel of the present invention to fully exhibit its features. Accordingly, an especially careful attention must be paid to the addition amount of C. For improving the toughness and resistance to weld cracking by reducing the formation quantity of the martensite island occurring in the weld heat affected zone, the amount of C must be lowered and preferably is not greater than 0.04%. In this manner, it is possible to restrict the amount of the martensite island to not greater than 15% by restricting also the C amount in the interrelation with the amounts of Ti and N which will be later described. Although the carbon content is preferably as small as possible, there is a problem of production cost in order to reduce it to less than 0.005% in a practical steel. Practically, therefore, the carbon content is preferably in the range of from 0.005 to 0.04%.

Furthermore, it is necessary to restrict the C content in conjunction with Ti or N. If the C content is not higher than the abovementioned upper limit of 0.04% or in the practical range of from 0.005 to 0.04%, it is difficult to perfectly eliminate the undersirable influence of the martensite island over the toughness in the weld heat affected zone. In addition to these limitations, therefore, the C content in conjunction with N, that is [C(%)+10 N(%)], must be restricted to not higher than 0.10% and in conjunction with Ti and N, Ti(%)/[C(%)+10 N(%)] must be in the range of from 0.05 to 0.60. These limitations furnish the heat affected zone with an excellent impact value.

Ti has the effects of reducing the formation quantity of the martensite island in the weld heat affected zone and further promoting the toughness in said zone together with the effect of preventing coarsening of an austenite grain size in the heat affected zone, especially at the weld bond of joint and the portion near the bond. If the Ti content is less than 0.005%, the effect of TiN for preventing the growth of the austenite grain size becomes insufficient and it also becomes difficult to fix the detrimental free nitrogen or render it innoxious. Desirably, therefore, at least 0.005% of Ti is to be added. On the other hand, the addition of an excessive amount of Ti is not desirable because it causes coarsening of TiN in the steel or the formation of large Ti-type inclusions and deteriorates the toughness not only of the heat affected zone but also of the base metal. Accordingly, the upper limit of the Ti content is preferably 0.030%.

It is also an essential requirement in the present invention that, as mentioned above, the Ti content is restricted in conjunction with C and N. Namely, the value Ti(%)/[C(%)+10 N(%)] must be in the range of from 0.05 to 0.60 under the condition of C(%)+10 N(%)≦0.10%. This constitutes one of the features of the present invention so that the amount of the martensite island occurring in the weld heat affected zone is restricted to not greater than 15%. If the value Ti(%)/[C(%)+10 N(%)] is less than 0.05, it is difficult to sufficiently reduce the amount of the martensite island, and if the value exceeds 0.60, on the other hand, the abovementioned adverse influences of Ti take place and deteriorate the toughness of the heat affected zone. For these reasons, the Ti content must be in the range of from 0.005 to 0.030% and at the same time, the value Ti/[C(%)+10 N(%)] be in the range of 0.05 to 0.60 [where the value C(%)+10 N(%) is restricted to not greater than 0.10% as mentioned above].

Nb is the basic element for the steel of the present invention. In other words, the steel dealt with by the present invention is a so-called Nb-containing steel. Nb is extremely effective for improving the strength and toughness of the steel and moreover is an economical element. The effect of addition of Nb increases with an increasing amount of addition in base metal but, the toughness in the weld heat affected zone and resistance to weld cracking tend to gradually deteriorate. Further, the addition of a large amount of Nb is not economical. For these reasons, the upper limit of the amount is preferably 0.07% while the lower limit is preferably 0.01% because the features of the Nb-containing steel can not sufficiently be obtained if the addition amount is too small.

As already mentioned, N is an element which provides a remarkable effect on the toughness in the weld heat affected zone in the same way as C does. The range of N content is determined in conjunction with C and Ti contents. Namely, the N content must satisfy the following two requirements;

$$C(\%)+10\,N(\%)\leqq 0.10\% \quad (1)$$

$$0.05\leqq Ti(\%)/[C(\%)+10\,N(\%)]\leqq 0.60 \quad (2)$$

If the carbon content is at the practical lower limit of 0.005% and the Ti content is at the upper limit of 0.03%, for example, the N content must be lower than 0.0095% ($\alpha$) from the formula (1) and 0.0045–0.0595% ($\beta$) from the formula (2). Hence, the N content must be from 0.0045 to 0.0095% that simultaneously satisfies both ($\alpha$) and ($\beta$). On the other hand, if the C content is at its upper limit of 0.04% and the Ti content is at its lower limit of 0.005%, the N content is not greater than 0.006% ($\gamma$) from the formula (1) and not greater than 0.006% ($\delta$) from the formula (2). Hence, the N content in this case is stipulated to not greater than 0.006% that simultaneously satisfies both ($\gamma$) and ($\delta$).

Si secures the strength of the base metal and is effective as a deoxidizer of steel making. For these purposes, 0.01–0.50% of Si is added.

In the same way as the abovementioned Si, Mn is added in order to provide the steel with a required strength. If the amount is less than 1.2%, it is difficult to obtain a yield strength of a class of 40 kg/mm$^2$ in the ultra-low carbon type steel of the present invention. Accordingly, at least 1.2% of Mn is preferably added. If Mn is added in excess, however, Mn segregation is promoted in the steel ingot, thereby not only deteriorating cleanliness of the steel but also facilitating the formation of the martensite island in the weld heat affected zone, enhancing the hardenability and degrading the toughness and resistance to weld cracking. Hence, the upper limit of the Mn content is desirably not greater than 2.5%.

Al is effective as a deoxidizing element during steel making and also as a grain refining element. It also functions as a nitride-forming element and fixes the free nitrogen formed in the weld heat affected zone and exhibits its effect for stabilizing and improving the toughness in the weld heat affected zone. However, the addition of Al in excess is not desirable because it causes increase of alumina-type inclusions and lowers the cleanliness of the steel. Preferably Al is added in an amount in the range of from 0.005 to 0.06%.

In addition to the abovementioned elements, the Nb-containing steel in accordance with the present invention may further incorporate, if necessary, solid solution elements such as Cu, Ni, Cr and Mo and trace elements such as V, B, Ca and Ce in proper amounts in order to further improve the toughness and other various properties such as strength. Needless to say, however, these additional elements must be added within the range that does not deteriorate the toughness in the weld heat affected zone and resistance to weld cracking. A predetermined limitation is further imposed on the amount of each element to be added in view of the peculiar action of the element over the properties of the steel strip such as strength and toughness and also from the aspect of the production technique.

Cu increases the strength without exerting the adverse effect over the toughness of the base metal and the weld heat affected zone and improves resistance to hydrogen-induced cracking and corrosion resistance. However, the upper limit is set to 0.50% because if the amount of Cu exceeds 0.50%, cracking tends to occur on the surface of the steel strip during rolling.

Though Ni has the effect of remarkably improving the toughness of the base metal and the weld heat affected zone, the addition of Ni in excess is not preferable for a weldable structure with which stress corrosion cracking is a serious problem and, invites the increase in the cost of production. It is therefore desired that Ni is added in an amount not greater than 1.50%.

Cr is a useful element for securing the strength of the base metal. However, the addition of Cr in an excessive amount causes hardening of the weld heat affected zone and deteriorates the resistance to weld cracking. For this reason, Cr is preferably added in an amount not greater than 0.50%.

Mo also is a useful element for maintaining the strength of the base metal. If added in an excessive amount, however, Mo increases the amount of the martensite island, lowers the toughness of the weld heat affected zone and enhances the weld crack sensitivity. Hence, Mo is preferably added in an amount not greater than 0.60%.

V is an element which is effective for enhancing the strength of the base metal and especially effective in achieving reduction of the carbon content and carbon equivalent. Since the addition of V in excess causes deterioration of the toughness in the weld heat affected zone and the weld metal portion, it is preferably added in an amount not greater than 0.10%.

When added in a trace amount, B improves the hardenability of the steel and is extremely effective for providing the ultra-low C-Nb-Ti type steel of the present invention with high strength. However, when B is added in a great amount, B compounds precipitate at the austenite grain boundary and extremely deteriorate the toughness of the base metal and the weld heat affected zone. It is therefore desired that the amount of B is not greater than 0.003%.

Ce has the effects of controlling the size, and shape of sulfide type inclusions formed in the steel, improves anisotropy, reduces the hydrogen-induced crack sensitivity, supresses the disolution of sulfide into austenite matrix due to thermal cycle of welding, and hence restricts the precipitation of S at the austenite grain boundary. By way of these effects, Ce improves the toughness in the weld heat affected zone in one side welding with one welding pass or both side welding with two layers. However, the addition of Ce in a great amount is not desirable because it forms sulfide-, oxide- or complex-type inclusions of Ce at the bottom of the steel ingot and causes occurrence of defects by ultrasonic fault detector. Accordingly, it is recommended to add Ce in an amount not exceeding 0.02%.

In addition to the same effect as the abovementioned Ce, fine inclusions of Ca control the coarsening of the austenite grain size in the weld heat affected zone and prevents the formation of the martensite island as they act as the nuclei of ferrite during transformation. In order to fully exhibit these effects of Ca, it is necessary to limit the amount of Ca to not greater than 0.003% and add it most preferably in the range of from 0.0005 to 0.002%.

Besides the abovementioned components, P and S are present in the steel as the inevitable impurities. Although the content of these impurities is desirably as low as possible, the present invention allows the presence of up to 0.020% of P and S.

There is no particular limitation to the operation condition for steel making, rolling, etc. of the steel in accordance with the present invention, and a production process for the ordinary Nb-containing steel may likewise be employed in the present invention. It is not necessary to apply the quenching and normalizing treatments to the steel after hot rolling. In other words, the steel strip as hot-rolled may be used as such without heat treatment. Moreover, various other steels may also be used such as a steel produced by accelerated-cooling after hot rolling, a steel further applied with the tempering treatment subsequent to the abovementioned accelerated-cooling and a steel strip subjected to the quenching and tempering treatment after hot rolling. In any of the abovementioned steels, it is possible to restrict the formation quantity of the martensite island in the weld heat affected zone to up to 15% and provide the steel with excellent properties such as good toughness and resistance to weld cracking.

The steel of the present invention will be explained more definitely with reference to the following examples.

EXAMPLE 1

A 18.3 mm-thick steel is produced by control-rolling using each of the steel ingots having the chemical composition shown in Table 1. For ready reference, Table 1 also illustrates a carbon equivalent (C.E.) expressed by the formula below and a PCM value which is generally used as a scale to express the weld crack sensitivity of the steel (the smaller the PCM value, the smaller the sensitivity).

$$C.E. = C + 1/6\ Mn + 1(Cr + Mo + V) + 1/15(Ni + Cu)$$

$$PCM = C + 1/30\ Si + 1/20(Mn + Cu + Cr) + 1/60\ Ni + 1/15\ Mo + 1/10\ V + 5\ B$$

Table 1

| Chemical composition of samples (wt %) | | | | | | | | | | | |
|---|---|---|---|---|---|---|---|---|---|---|---|
| Sample | C | Si | Mn | P | S | Nb | Al | Ti | N | Cu | Ni |
| A | 0.03 | 0.11 | 2.17 | 0.012 | 0.005 | 0.053 | 0.02 | 0.019 | 0.006 | — | 0.27 |
| B | 0.03 | 0.41 | 1.79 | 0.016 | 0.006 | 0.042 | 0.04 | 0.017 | 0.003 | 0.37 | 0.21 |
| C | 0.03 | 0.18 | 1.80 | 0.015 | 0.006 | 0.056 | 0.06 | 0.023 | 0.005 | — | — |
| D | 0.03 | 0.05 | 1.82 | 0.013 | 0.004 | 0.039 | 0.03 | 0.026 | 0.005 | — | 0.25 |
| E | 0.02 | 0.45 | 1.43 | 0.014 | 0.006 | 0.057 | 0.03 | 0.018 | 0.002 | — | 0.50 |
| F | 0.02 | 0.16 | 1.91 | 0.014 | 0.005 | 0.024 | 0.04 | 0.009 | 0.004 | 0.13 | — |
| G | 0.04 | 0.28 | 1.38 | 0.015 | 0.006 | 0.062 | 0.04 | 0.006 | 0.003 | — | — |
| H | 0.03 | 0.15 | 2.33 | 0.015 | 0.006 | 0.055 | 0.03 | 0.028 | 0.002 | — | — |
| I | 0.02 | 0.15 | 1.77 | 0.017 | 0.003 | 0.029 | 0.04 | 0.024 | 0.003 | — | — |
| J | 0.04 | 0.29 | 2.08 | 0.012 | 0.002 | 0.046 | 0.02 | 0.005 | 0.006 | — | 0.88 |
| K | 0.06 | 0.11 | 1.87 | 0.014 | 0.005 | 0.053 | 0.03 | 0.021 | 0.003 | — | 0.28 |
| L | 0.03 | 0.22 | 1.80 | 0.014 | 0.004 | 0.050 | 0.04 | 0.057 | 0.010 | — | 0.35 |
| M | 0.06 | 0.36 | 1.73 | 0.017 | 0.005 | 0.042 | 0.04 | 0.080 | 0.007 | — | 0.51 |

Table 1-continued

| Chemical composition of samples (wt %) | | | | | | | | | | | |
|---|---|---|---|---|---|---|---|---|---|---|---|
| N | 0.05 | 0.08 | 1.95 | 0.015 | 0.004 | 0.027 | 0.03 | — | 0.003 | — | — |
| O | 0.11 | 0.09 | 1.51 | 0.012 | 0.004 | 0.022 | 0.04 | — | 0.004 | — | — |
| P | 0.11 | 0.30 | 1.65 | 0.014 | 0.006 | 0.090 | 0.03 | 0.019 | 0.005 | — | — |
| Q | 0.15 | 0.15 | 1.39 | 0.014 | 0.002 | 0.055 | 0.05 | 0.008 | 0.003 | — | — |
| R | 0.06 | 0.33 | 1.92 | 0.016 | 0.003 | 0.060 | 0.03 | — | 0.007 | — | — |

| Sample | Cr | Mo | V | B | Ca | Ce | C+ 10N | Ti* C+ 10N | C.E. | PCM |
|---|---|---|---|---|---|---|---|---|---|---|
| A | — | 0.35 | — | — | — | — | 0.09 | 0.21 | 0.48 | 0.17 |
| B | — | — | — | — | — | — | 0.06 | 0.28 | 0.37 | 0.16 |
| C | 0.24 | 0.33 | — | — | — | — | 0.08 | 0.29 | 0.44 | 0.16 |
| D | 0.17 | 0.14 | — | — | — | — | 0.08 | 0.33 | 0.41 | 0.14 |
| E | — | — | — | 0.001 | 0.001 | — | 0.04 | 0.45 | 0.29 | 0.11 |
| F | — | — | — | 0.002 | — | — | 0.06 | 0.15 | 0.35 | 0.14 |
| G | — | — | — | — | — | — | 0.07 | 0.09 | 0.27 | 0.12 |
| H | — | — | 0.04 | — | — | 0.011 | 0.05 | 0.56 | 0.43 | 0.16 |
| I | 0.36 | — | 0.07 | — | — | — | 0.05 | 0.48 | 0.40 | 0.14 |
| J | — | 0.53 | — | — | — | — | 0.10 | 0.05 | 0.55 | 0.20 |
| K | — | 0.36 | — | — | — | — | 0.09 | 0.23 | 0.46 | 0.19 |
| L | 0.37 | — | — | — | — | — | 0.13 | 0.44 | 0.43 | 0.15 |
| M | 0.16 | — | — | — | — | — | 0.13 | 0.62 | 0.41 | 0.18 |
| N | 0.25 | 0.34 | — | — | — | — | 0.08 | — | 0.49 | 0.19 |
| O | — | — | 0.10 | — | — | — | 0.15 | — | 0.38 | 0.20 |
| P | 0.24 | — | — | — | — | — | 0.16 | 0.12 | 0.43 | 0.21 |
| Q | — | 0.20 | 0.07 | 0.001 | — | — | 0.18 | 0.04 | 0.43 | 0.25 |
| R | — | 0.34 | — | — | — | — | 0.13 | — | 0.45 | 0.19 |

*no unit

An impact value at the weld bond of joint is examined by applying both side submerged arc welding with one pass in each groove having a weld heat input of 40 KJ/cm and one side submerged arc welding with one pass having a weld heat input of 100 KJ/cm to each of the samples A through R (thickness: 18.3 mm) shown in Table 2. The "Battelle type underbead cracking test", which has the lowest heat input among the circular seam welding, and the "Y-slit weld crack test" in accordance with JIS Z 3158 are conducted for each sample in order to examine the resistance to weld cracking. Results are shown in Table 2 wherein A through J are samples of the present invention, K through Q are comparative samples similar to the present samples and R is a comparative sample having a typical conventional Nb-containing steel composition.

Table 2

| Test Results | | | | | | | | |
|---|---|---|---|---|---|---|---|---|
| | Tensile property of base metal (Kg/mm²) *1 | | 50% FATT of base metal | Toughness at bond vEo (Kg-m) | | Crack*2 | Crack-preventing temperature (°C.) *3 | |
| Sample | Y.S. | T.S. | (°C.) | 40 KJ/cm | IOC KJ/cm | Ratio (%) | I | II |
| This invention | | | | | | | | |
| A | 52.7 | 68.2 | −103 | 12.3 | 11.2 | 4 | 50 | ≦−15 |
| B | 49.9 | 60.9 | −105 | 15.1 | 10.7 | 2 | 50 | ≦−15 |
| C | 42.5 | 62.2 | −97 | 11.6 | 9.5 | 0 | 50 | ≦−15 |
| D | 51.4 | 63.3 | −101 | 14.1 | 12.2 | 0 | 25 | ≦−15 |
| E | 47.1 | 55.1 | −102 | 13.3 | 9.9 | 5 | 50 | ≦−15 |
| F | 50.5 | 62.7 | −89 | 100 | 8.3 | 2 | 50 | ≦−15 |
| G | 45.2 | 50.9 | −94 | 109 | 8.4 | 0 | 25 | ≦−15 |
| H | 51.8 | 63.5 | −97 | 10.8 | 8.6 | 0 | 50 | ≦−15 |
| I | 45.6 | 62.2 | −102 | 11.7 | 9.5 | 1 | 50 | ≦−15 |
| J | 71.4 | 79.6 | −91 | 9.5 | 8.3 | 3 | 75 | 0 |
| Comparative | | | | | | | | |
| K | 51.2 | 68.8 | −86 | 5.9 | 3.3 | 8 | 125 | 0 |
| L | 44.6 | 63.2 | −87 | 4.2 | 2.9 | 5 | 75 | 0 |
| M | 52.4 | 61.5 | −83 | 6.3 | 3.7 | 7 | 125 | 0 |
| N | 48.1 | 66.1 | −88 | 4.9 | 3.2 | 9 | 125 | 0 |
| O | 53.7 | 65.5 | −87 | 2.9 | 2.3 | 37 | 175 | 75 |
| P | 54.0 | 67.2 | −77 | 2.8 | 1.6 | 32 | 175 | 75 |
| Q | 68.9 | 75.4 | −81 | 3.6 | 3.0 | 30 | 225 | 100 |
| Prior art | | | | | | | | |
| R | 53.1 | 73.2 | −79 | 2.5 | 1.4 | 26 | 150 | 75 |

*1 : Directing of testpiece; →Crosswise direction
*2 : Crack ratio in Battelle type undesired cracking test. [Using a high cellulose-type electrode; initial welding temp. =0° C.]
*3 : Root-crack preventing temperature in Y-slit weld crack test.
(I) Using a high cellulose type;
(II) Using low-H type electrodes:

As shown in Table 2 above, the impact value (vEo) at the bond of the samples A–J of the present invention exhibits a value as high as 8 kg-m or more irrespective of the quantity of the weld heat input. By contrast, the comparative samples K–Q, which, though having the composition similar to the present samples, fail to satisfy the requirements of the C+10 N value and the Ti/(C+10 N) value, and the comparative sample R have an impact value of from 2 kg-m to 6 kg-m at most. In comparison with these comparative samples, the toughness at the weld bond of joint of the samples of the present invention has an excellent value higher by about 2 to 7 times.

As shown in the column "crack ratio", whereas the resistance to weld cracking of the comparative samples K–R ranges from 5 to about 40%, it is from 0% to 5% at most in the samples of the present invention and extremely excellent.

As further shown in the column "crack preventing temperature", the root crack preventing temperature in the Y-slit weld crack test is about 125°–175° C. for the comparative samples K–R and in the present invention, it is extremely low, i.e., about 25°–50° C. and 75° C. at the highest, when a high cellulose type electrode is used (column I). On the other hand, when the low hydrogen type electrode is used (column II), the temperature is from 0° to 100° C. for the comparative samples K–R whereas it is extremely low, i.e., −15° C. or below, in the samples of the present invention. When compared with the values of the comparative samples K through R, these values are found to be excellent.

Figure 3:
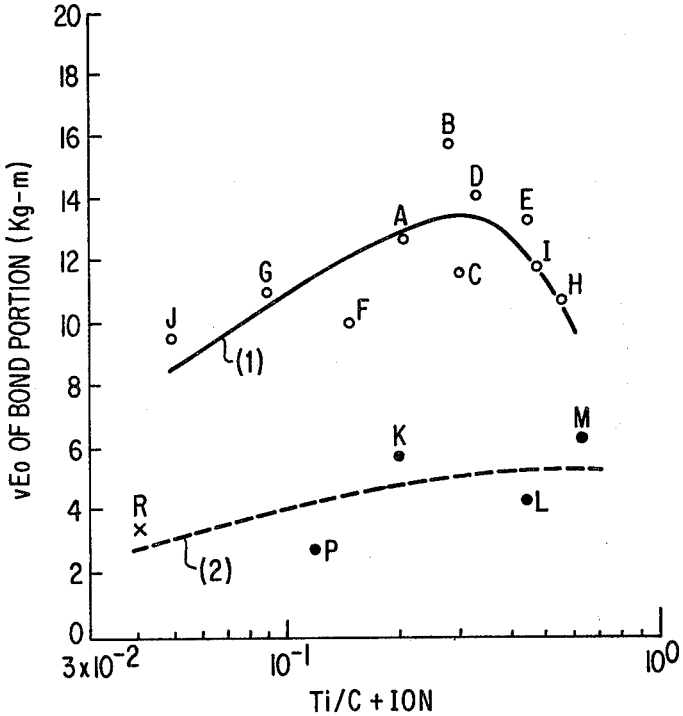
FIG. 3 is a diagram showing the relation between the impact value in the weld bond portion and Ti(%)/[C(%)+10 N(%)]
Figures 2, 5:
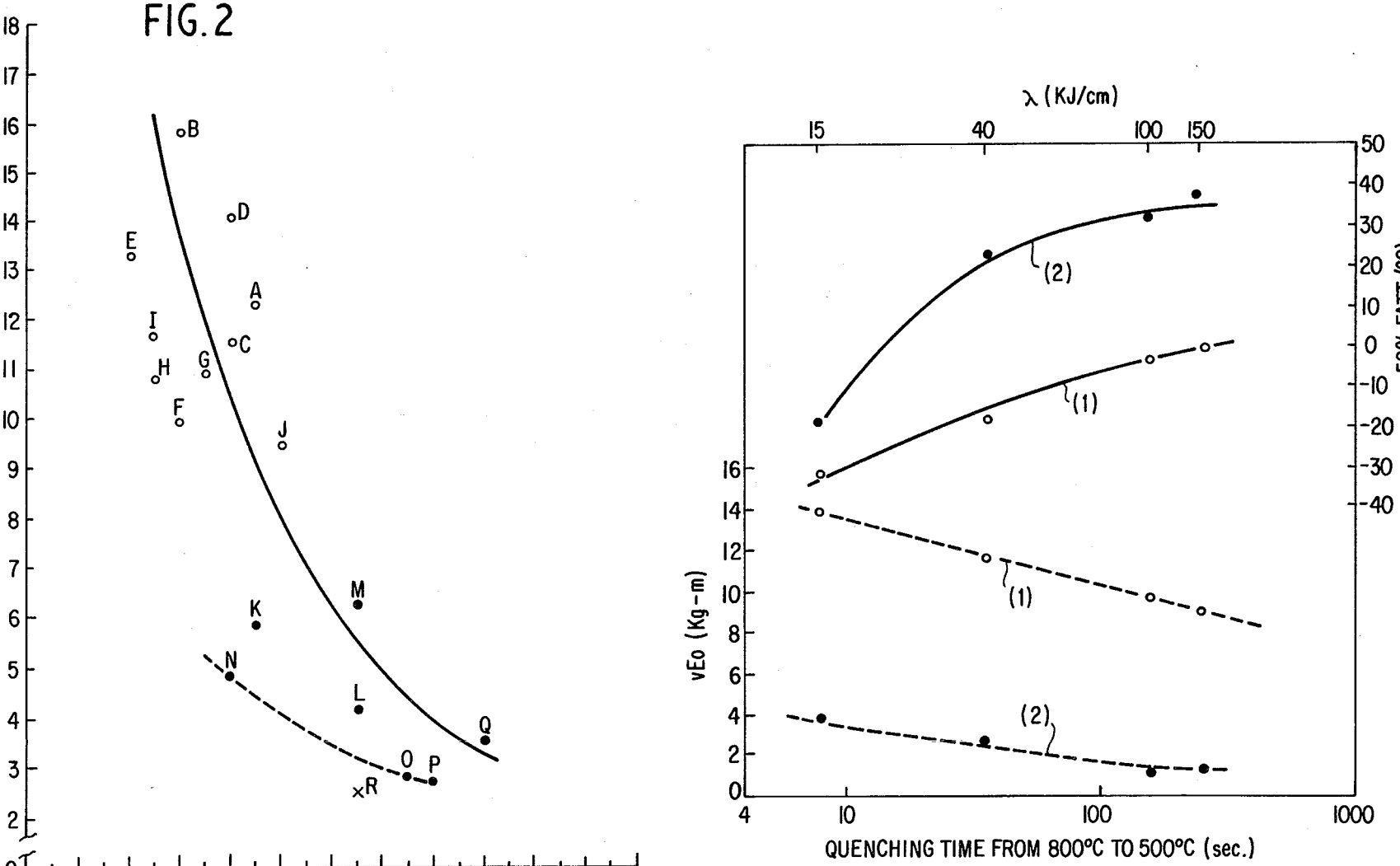
FIG. 2 is a diagram showing the relation between the impact value in the weld bond portion and C(%)+10 N(%)
FIG. 5 is a diagram showing the influence of the weld heat input on the toughness in the weld heat affected zone in accordance with the synthetic heat affected zone test.

The accompanying FIGS. 1 through 3 are diagrams each showing the results of the abovementioned Table 2 in conjunction with C(%)+10 N(%) or Ti(%)/[C(%)+10 N(%)]. In the diagrams the symbols correspond to the samples numbers of Table 2 and the marks represent the samples in the following manner;

○: samples of the present invention

●: comparative samples K–Q

X: comparative sample R having the conventional composition

FIG. 1 illustrates the relationship between the amount of the martensite island formed at the weld bond of joint obtained by both side submerged arc welding with one pass in each groove and [C(%)+10 N(%)]. The quantity of the martensite island formed is measured by the use of a quantitative television microscope image analyzer (Q.T.M., a product of Metal Research Company). In the diagram, the full line is a curve connecting the values of the Ti-containing samples and the dash line is a curve connecting the values of the samples not containing Ti (samples N, O and R). As can be seen from the diagram, the amount of the martensite island decreases with a decreasing value of [C(%)+10 N(%)] and when [C(%)+10 N(%)] is restricted to not greater than about 0.10%, the quantity of the martensite island is restricted to not greater than about 15%.

FIG. 2 is a diagram showing the relationship between [C(%)+10 N(%)] and the impact value (vEo) at the weld bond of joint obtained by both side submerged welding with one pass in each groove. The vEo value rapidly increases as the C(%)+10 N(%) value decreases. From this FIG. 2 together with the abovementioned FIG. 1, it can be appreciated that reducing the amount of the martensite island functions as an important factor for improving the toughness in the weld heat affected zone.

FIG. 3 is a diagram showing the influence of Ti/[C(%)+10 N(%)] over the impact value (vEo) of the weld bond of joint obtained by both side submerged arc welding with one pass in each groove, wherein the curve (1) represents the samples of the present invention and the curve (2) does the comparative samples.

It can be understood from this FIG. 3 in conjunction with the abovementioned FIG. 2 that the impact value (vEo) at the weld bond of joint can be maintained at a high value of 8 kg-m or more by stipulating the value C(%)+10 N(%) to not greater than 0.10% and the value Ti(%)/[C(%)+10 N(%)] in the range of from 0.05 to 0.60.

FIGS. 4-[I] and -[II] respectively show the microscopic structure (magnification: 200X) of the weld bond and its proximity of the sample A of the present invention and the sample R of the prior art obtained by both side submerged arc welding with one pass in each groove. It can be seen by comparing these figures that the quantity of the martensite island formed in the bainite structure is reduced to a marked extent in the sample of the present invention (FIG. 4-[I]).

EXAMPLE 2

The influence of the weld heat input over the toughness of the weld heat affected zone is examined for the sample A of the present invention and the comparative sample R, each having the composition shown in Table 1, in accordance with the synthetic heat affected zone test.

The heat cycle employed is a single heat cycle having a maximum heating temperature of 1300° C. and a cooling time each of 8 sec., 36 sec., 160 sec. and 250 sec. from 800° C. to 500° C. In other words, a 2 mm V-notch charpy impact test is conducted while heat cycles each corresponding to 16 KJ/cm, 40 KJ/cm, 100 KJ/cm and 150 KJ/cm are imparted to the steel having a thickness of 18.3 mm. Results are shown in FIG. 5 in which the dash line represents an impact value (vEo), the full line does 50%-fracture appearance transition temperature (50%-FATT; vTrs), the curve (1) represents the sample A of the present invention and the curve (2) represents the comparative sample R.

It can be seen from FIG. 5 that irrespective of the weld heat input quantity, the sample of the present invention has a higher impact value (vEo), a lower 50%-FATT and better property than the comparative sample R. In addition, degradation of 50%-FATT in the sample A is found smaller and less sensitive to the increase in the cooling time from 800° C. to 500° C. (increase in the weld heat input).

EXAMPLE 3

By way of the Battelle type underbead test and the Y-slit weld crack test, changes in the toughness at the weld bond of joint and resistance to weld cracking in the case of a yield strength of a class of 40–70 kg/mm$^2$ are examined using the steels of a varying composition as shown in Table 3 (samples S and T being the present sample and V a comparative sample) that have been subjected to any of the following treatments;

(a) rolling (b) tempering after rolling (c) accelerated-quenching immediately after rolling (d) tempered after treatment (c)

(e) quenching and tempering after rolling Results are shown in Table 4.

Table 3

| | Chemical composition of samples (wt %) | | | | | | | | |
|---|---|---|---|---|---|---|---|---|---|
| Sample | C | Si | Mn | P | S | Cu | Ni | Cr | Mo → |

Table 3-continued

| Chemical composition of samples (wt %) | | | | | | | | | |
|---|---|---|---|---|---|---|---|---|---|
| Steels of this invention | | | | | | | | | |
| S | 0.03 | 0.18 | 1.92 | 0.015 | 0.004 | — | — | — | 0.34 |
| T | 0.02 | 0.13 | 2.14 | 0.012 | 0.003 | 0.15 | 0.81 | 0.15 | 0.43 |
| Conventional steels | | | | | | | | | |
| U | 0.06 | 0.10 | 1.86 | 0.013 | 0.006 | — | — | — | 0.38 |

→

| Sample | Nb | Ti | Ce | Ca | N | C + 10N | Ti* C + 10N | C.E. | PCM |
|---|---|---|---|---|---|---|---|---|---|
| Steels of this invention | | | | | | | | | |
| S | 0.049 | 0.015 | 0.005 | — | 0.004 | 0.07 | 0.21 | 0.42 | 0.15 |
| T | 0.037 | 0.019 | — | 0.001 | 0.005 | 0.07 | 0.27 | 0.56 | 0.19 |
| Conventional steels | | | | | | | | | |
| U | 0.056 | — | 0.009 | — | 0.005 | 0.11 | — | 0.45 | 0.18 |

*No unit

Table 4

| | | | Properties of base metal* | | | |
|---|---|---|---|---|---|---|
| | | | Tensile test | | impact test 50% | DWTT 85% |
| Sample | Thickness (mm) | Processing after rolling | Y.S. (Kg/mm²) | T.S. (Kg/mm²) | FATT (°C.) | SATT (°C.) |
| S | 18.3 | a | 49.6 | 65.3 | −110 | −61 |
| S | 18.3 | b | 55.3 | 65.6 | −98 | −53 |
| S | 18.3 | c | 57.0 | 73.8 | −95 | −49 |
| S | 18.3 | d | 59.8 | 72.1 | −90 | −46 |
| S | 18.3 | e | 63.6 | 73.3 | −84 | −40 |
| T | 12.7 | a | 72.4 | 81.9 | −93 | −51 |
| T | 12.7 | e | 78.6 | 83.5 | −119 | −66 |
| U | 18.3 | a | 51.2 | 68.8 | −103 | −58 |
| U | 18.3 | e | 65.3 | 75.2 | −88 | −43 |

| | | | Impact property of bond | | | | | | |
|---|---|---|---|---|---|---|---|---|---|
| | | | heat input 40 KJ/cm | | heat input 100 KJ/cm | | Weld crack sensitivity | | |
| | | | | 50% | | 50% | I | II | |
| Sample | Thickness (mm) | Processing Step | Eo (Kg-m) | °C.) | FATT Kg-m) | (°C.) | (i) | (ii) | (iii) |
| S | 18.3 | a | 15.5 | −18 | 13.3 | −5 | 0 | 50 | ≦−15 |
| S | 18.3 | b | 14.2 | −23 | 11.8 | −7 | 0 | 50 | ≦−15 |
| S | 18.3 | c | 16.7 | −12 | 12.1 | −4 | 1 | 50 | ≦−15 |
| S | 18.3 | d | 12.1 | −20 | 11.3 | 0 | 0 | 50 | ≦−15 |
| S | 18.3 | e | 13.9 | −16 | 12.5 | −9 | 2 | 50 | 0 |
| T | 12.7 | a | 11.8 | −10 | 13.7 | −1 | 5 | 75 | 0 |
| T | 12.7 | e | 12.2 | − 8 | 11.4 | −3 | 4 | 75 | 0 |
| U | 18.3 | a | 4.3 | 23 | 3.6 | 30 | 24 | 125 | 0 |
| U | 18.3 | e | 4.7 | 25 | 2.9 | 38 | 27 | 125 | 0 |

*:Direction of testpiece; Crosswise direction

In the column "weld crack sensitivity" in Table 4, [I] and [II] represent respectively the Battelle type underbead test and the Y-slit weld crack test wherein (i) is an underbead cracking ratio (%) at the weld initial temperature of 0° C., (ii) is the root crack preventing temperature (°C.) when the high cellulose type electrode is used and (iii) is the root crack preventing temperature (°C.) when the low hydrogen type electrode is used.

As can be seen from Table 4, the properties in the base metal and the weld bond of joint of the present samples S and T are better than those of the comparative sample U. Especially, the advantages of the present invention in the properties of welded bond and in the resistance to weld cracking remain unaltered when steel is subjected to various heat treatments after hot rolling. Thus, the present steels are found to maintain excellent weldability.

What is claimed is:

1. A niobium-containing weldable structural steel having good weldability which consists of 0.005–0.04% of C, 0.01–0.50% of Si, 1.20–2.50% of Mn, 0.01–0.07% of Nb, 0.005–0.030% of Ti, 0.005–0.06% of Al and the balance of iron and inevitable impurities whereby (C(%)+10 N(%)) is not greater than 0.10% and Ti(%)/(C(%)+10 N(%)) is from 0.05 to 0.60 whereby the amount of the martensite islands in the weld heat affected zone when said steel is subjected to a welding process is not greater than 15% in terms of the area fraction.

2. A niobium-containing weldable structural steel having good weldability which consists of 0.005–0.04% of C, 0.01–0.50% of Si, 1.20–2.50% of Mn, 0.01–0.07% of Nb, 0.005–0.030% of Ti, 0.005–0.06% of Al, at least one element in the specified amount selected from the group consisting of up to 0.50% Cu, up to 1.50% Ni, up to 0.50% Cr, up to 0.60% Mo, up to 0.10% V, up to 0.003% B, up to 0.02% Ce and up to 0.003% Ca, and the balance of iron and inevitable impurities wherein (C(%)+10 N(%)) is not greater than 0.10% and Ti(%)/(C(%)+10 N(%)) is from 0.05 to 0.60% whereby the amount of the martensite islands in the weld heat affected zone when said steel is subjected to a welding process is not greater than 15% in terms of the area fraction.

* * * * *